United States Patent [19]

Freeman

[11] Patent Number: 4,798,648

[45] Date of Patent: Jan. 17, 1989

[54] ARTICLE FEEDING DEVICES FOR LABELLERS

[75] Inventor: Michael Freeman, Clacton-On-Sea, England

[73] Assignee: John Waddington PLC, England

[21] Appl. No.: 25,411

[22] Filed: Mar. 13, 1987

[30] Foreign Application Priority Data

Mar. 18, 1986 [GB] United Kingdom ..... 8606628

[51] Int. Cl.[4] ..... B65C 9/02

[52] U.S. Cl. ..... 156/542; 156/556; 156/567; 156/DIG. 12; 156/DIG. 21; 156/DIG. 25; 198/346.2; 198/467.1

[58] Field of Search ..... 198/346.2, 467.1, 480.1; 156/DIG. 12, DIG. 25, DIG. 27, 521, 542, 559, 560, 567, 212, 540, 541, 556, 566, 568

[56] References Cited

U.S. PATENT DOCUMENTS

| | | | |
|---|---|---|---|
| 3,314,519 | 4/1967 | Kelly | 198/467.1 |
| 3,532,583 | 10/1970 | Thiele | 156/559 |
| 3,586,560 | 6/1971 | Dullinger | 156/481 |
| 4,201,621 | 5/1980 | Crankshaw et al. | 156/567 |
| 4,230,219 | 10/1980 | Pezzin | 198/480.1 |
| 4,441,955 | 4/1984 | Richardson | 156/567 |
| 4,629,528 | 12/1986 | Tanaka et al. | 156/DIG. 33 |
| 4,660,708 | 4/1987 | Willerding | 198/467.1 |

FOREIGN PATENT DOCUMENTS

| | | | |
|---|---|---|---|
| 2559168 | 7/1976 | Fed. Rep. of Germany | 156/567 |
| 833685 | 4/1960 | United Kingdom | 156/DIG. 25 |
| 2034664 | 6/1980 | United Kingdom | 156/542 |

*Primary Examiner*—Merrell C. Cashion, Jr.
*Attorney, Agent, or Firm*—Klauber & Jackson

[57] ABSTRACT

An article feeding device is disclosed which comprises a straight scroll for feeding articles held between the scroll flights one by one along a straight path. A star wheel having peripheral pockets is arranged so that the wheel lies approximately tangentially to the scroll and rotates as the scroll turns. By this means, the articles are engaged in the star wheel pockets and are moved slightly away from the scroll at which point labels are applied thereto, and then the articles are returned to the scroll and released from the star wheel for continued feeding by the scroll.

3 Claims, 2 Drawing Sheets

ARTICLE FEEDING DEVICES FOR LABELLERS

This invention relates to article feeding devices, and more specifically concerns a device for the feeding of articles by means of a screw or scroll conveyor, the feeding of the articles being achieved in that the articles are engaged between adjacent portions of the screw or scroll conveyor flights, so that as the screw or scroll turns, so the articles are fed longitudinally of the screw or scroll.

The invention has particular, although not exclusive, application to the feeding of articles such as bottles which are held upright whilst being conveyed, for example through a label applicator machine.

Typically, in such applications as indicated above, the articles ar fed by the screw or scroll conveyor only at the input end of the device. The articles in fact stand on an input band conveyor, and the screw or scroll device serves as a means of pitching the articles one relative to another as they are fed into the machine. The machine may typically in the case of a label applicator comprise other feeding devices such as star wheels which receive the articles fed by the screw or scroll conveyor and direct the articles through further passes of the machine during which operations, such as the application of labels or the filling of the articles are performed thereon, and it is usual to deliver the articles on which the operations have been performed to an output conveyor of the machine, which may typically be a band conveyor on which the articles stand. It is not unusual for the output band conveyor to be in alignment with the input band conveyor which operates in conjunction with the screw or scroll device, and indeed in some machines the output band conveyor and input band conveyor are defined by one and the same endless band.

The other feeding devices such as star wheels in fact take the articles from a straight line path defined by the input and output conveyors, and move the articles laterally of the path so that the operations can be performed thereon and in the case where star wheels are used for feeding the articles whilst they are being operated thereon, it is usually necessary to provide at least three star wheels, and in all cases an odd number of star wheels in order to return the articles back to the said straight line path. This represents obviously an expense and a delay in the conveying system.

It has been deemed necessary heretofore to remove the articles from the scroll or screw device whilst the operations are being performed thereon, because a scroll or screw device does not form a sufficiently positive engagement means for the articles, in engaging the articles at points on the flights thereof which are at different heights, whereas by engaging the articles by for example star wheels a more positive control over the position can be maintained whilst other operations such as filling and labelling are being performed thereon.

Scroll feed devices for the feeding of articles such as bottles are disclosed in British Pat. Nos. 731070 and 833685. In the said British Pat. No. 731070, a scroll device is used in conjunction with a labelling apparatus. The articles are fed by the scroll device to the labelling apparatus, and then are engaged by friction feed belts to continue the movement of the articles after labelling, but the articles do not move out of a particular path of travel. In British Pat. No. 833685, articles are fed by an in feed scroll device and subsequently are engaged by a star wheel for the holding of same whilst the articles are labelled. The articles are fed on a conveying device, and are turned through 180° so as to be labelled on the opposite side by means of a second star wheel and labelling arrangement.

In French Pat. No. 1530326, U.S. Pat. No. 4,384,518 and German Specification No. 2807792 there are disclosed devices for the labelling of articles wherein the articles are moved out of a predetermined path of travel in order to have the labelling effected thereto, but the apparatus shown in these specifications are not designed to function on the concept of the present invention.

The present invention seeks to provide a device wherein the removal of the articles from the line of operation of the screw or scroll device is eliminated whereby the path of travel of the articles through the machine with which the device is used can be made much simpler and also whereby the problem with some conventional machines regarding the returning of the articles to the output conveyor, is obviated or mitigated.

In accordance with the present invention an article feeding device comprises a scroll or screw for operation in a substantially horizontal disposition whereby articles can be fed in the length direction of the screw or scroll by being located between adjacent portions of the flight means thereof, and the screw or scroll device is in operational relationship with a star wheel which can engage and hold the articles positively whilst an operation is performed thereon, said star wheel overlapping the screw or scroll device and arranged to operate in synchronism therewith so that pockets in the screw or scroll device respectively engage the articles and move them only slightly laterally of the screw or scroll device so that they become clear of the flight means and are held by the star wheel but only over a portion of one rotation of the star wheel and during such portion, the articles continue to be moved by the star wheel substantially axially of the screw or scroll device, and at the end of said portion of movement are returned to the feeding position between adjacent portions of the screw or scroll flight means and feeding of the articles continues in the axial direction of the screw or scroll device.

Suitably, the star wheel comprises a pair of spaced star discs and the screw or scroll device extends therebetween but so as to lie, in relation to the axis of rotation of the star wheel, so that the outer edge of the screw or scroll device is disposed only slightly inwardly of the position which is tangential to the star wheel, thereby ensuring the slight displacement of the articles one by one from engagement by the screw or scroll device over a relatively small angle of rotation i.e. less than a quarter of a turn of the star wheel.

The operation which is performed upon the articles when they are so moved clear of the screw or scroll device may comprise for example the application of a label to each article, but further operations can be performed thereon if required.

Embodiments of the invention will now be described, by way of example, with reference to the accompanying diagrammatic drawings, wherein.

Figure 1:
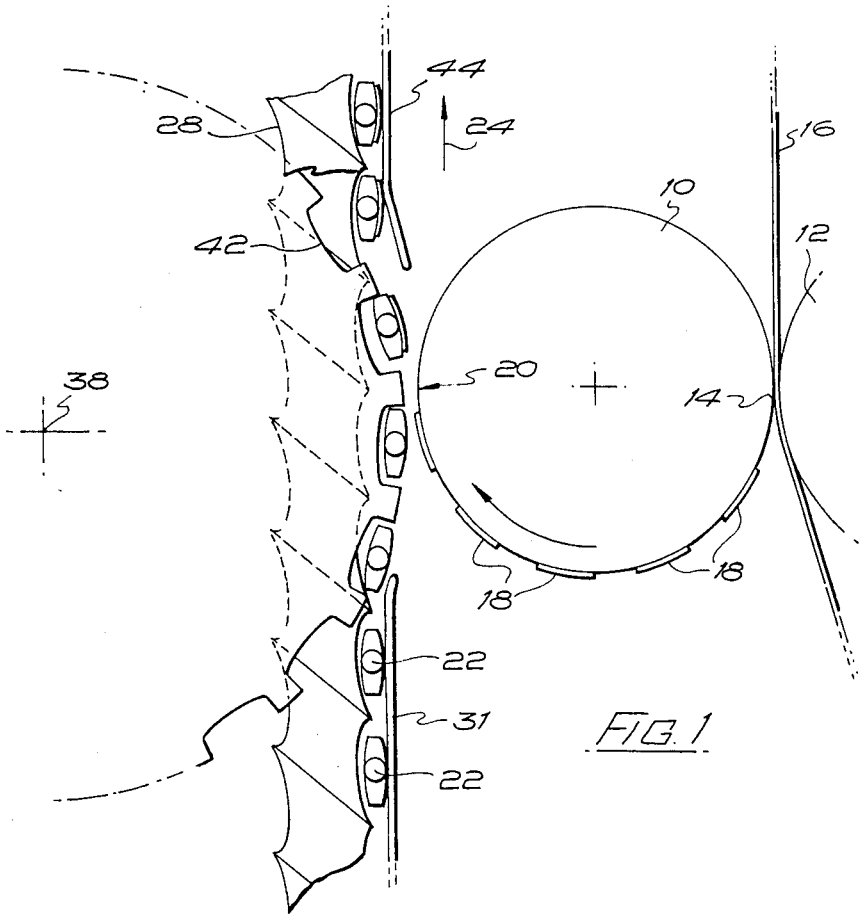
FIG. 1 is a plan view of a device according to a first embodiment of the invention.

Referring to the drawings, in FIG. 1 there is shown a vacuum drum 10 which cooperates with a die cutting drum 12 and these two drums together form a nip 14 through which a web 16 of material on which labels are printed passes, and as the web 16 passes the nip 14, individual labels 18 are cut therefrom, and are held to the drum 10 until they reach an application location 20 whereat the labels are applied individually to articles 22 being fed linearly and tangentially to the drum as indicated by arrow 24.

The web 16 is a backingless self adhesive label web, and we have already invented technology for the construction and manufacture of such a web 16, for the coating of same with adhesive on one side and release coat on the other side, and we have also invented methods of holding the labels 18 to the drum 10 and releasing same at location 20 as well as constructions for cutting the individual label 18 from the web 16 and such inventions are the subject of the following patent applications;

European Patent Application No. 82306505.7
European Patent Application No. 85110025.5
British Patent Application No. 8526582
British Patent Application No. 8602510

Figure 2:
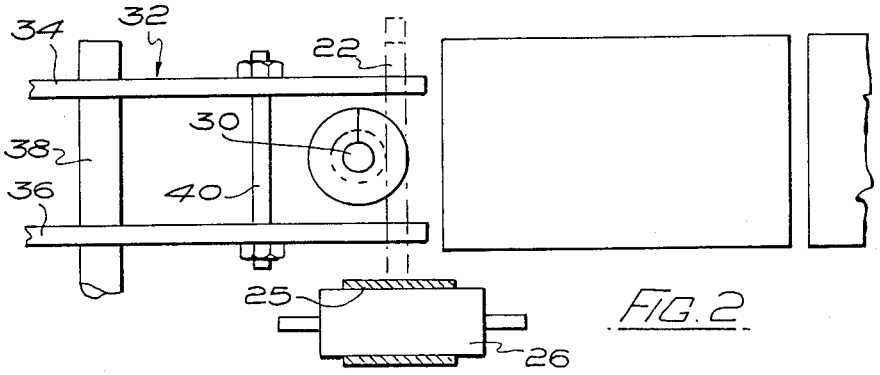
FIG. 2 is a side view of the arrangement shown in FIG. 1.

The present invention however is concerned with the feeding of the articles 22, in this case plastic bottles, and a first embodiment of the invention is shown in FIGS. 1 and 2.

As can be understood from FIGS. 1 and 2, the articles 22 are relatively flat, slender and tall bottles, which may contain, simply for example, hair shampoo or bubble bath lotion and, as shown in FIG. 2, they stand on the upper reach 25 of a conveyor belt which at the ends of reach 25 passes round guide and drive rollers, such as roller 26 shown in FIG. 2 whereby the belt of the reach 25 travels in the direction indicated by arrow 24.

The bottles 22 are held in spaced relationship by being engaged between adjacent portions of a flight of a screw or scroll conveyor 28 which as shown lies with its axis of rotation 30 slightly offset from the central plane of the upper reach 25 of the belt. The belt will normally run at a speed which is faster than that at which the articles would be moved by the rotation of the scroll 28, and as the articles 22 approach the application location 20, they are held against the scroll conveyor by means of a guide 31.

Operating in conjunction with the scroll 28 is a star wheel 32 comprising upper and lower spaced star wheel plates 34 and 36. The wheel is rotatable about axis 38, and the plates for example are secured together by means of bolts 40 located inwardly of the outer periphery of the wheel 32 so that, as shown in FIG. 2, the scroll conveyor 28 can pass between the plates 34 and 36 and the scroll 30 lies such that as related to the axis of rotation of the shaft 38, the outer edge of the scroll 28 is spaced slightly inwardly from the tangent to the outer periphery of the wheel 32. The plates 34 and 36 have pockets 42 formed therein, contoured to the shape of the article 22 to be handled thereby so that when the article 22 is held in the pockets 42 of the plates 34 and 36, it is held securely and firmly and cannot rock about a horizontal axis.

The spatial disposition of the star wheel 32 in relation to the scroll 28 is such that, as shown clarly in FIG. 2, as the respective articles 22 as they move in the direction of arrow 24 are engaged by the pockets 42, they are moved outwardly out of engagement with the scroll 28, but not off the surface of the conveying reach 25 and are presented to the drum 10 at the application location 20 so that the labels 18 can be applied thereto as shown in FIG. 1. By so removing the bottles 22 only slightly from the flight of the scroll 28, it is ensured that the firm holding and positioning of the bottles will be achieved by means of the pockets 42 whilst the label is being applied. This is important for the accurate registration of the label on the bottle and prevents the bottle from rocking or tilting into the wrong position during label application. As soon as the labels are applied, it will be noticed as shown in FIG. 1 that the articles 22 are returned to engagement with the scroll 28, and as the wheel 32 continues to rotate, so the articles 22 again come under the control feeding by the scroll 30, and there is a further guide 44 for holding the articles to the scroll 28.

By the means of the embodiment of the present invention, it will be seen that the articles 22 essentially continue to move in a linear direction as indicated by arrow 24 except for a slight displacement laterally of same at the application station 20, and this avoids the need to have to take the articles 22 around a large peripheral range of the star wheel 28, to transfer them to another star wheel for the application, and to provide yet a third star wheel for returning the articles back into alignment with the articles being infed on the conveyor reach 25. In fact the articles never leave the conveyor reach 25 in accordance with the embodiment of the invention described and this provides for higher speed application, smaller space take-up by the machinery and a less expensive machine.

Although the scroll illustrated in FIG. 2 is shown as being provided with an even pitch flight, in fact the flight may be one which is evenly pitched over only the section which is overlapped by the star wheel 32. The infeed portion of the flight may be of progressively increasing pitch, in order to increase the spacing between the articles, and the exit portion of the scroll may also be of increasing pitch enough to accelerate the articles away from the application location, but in any event the flight pitching can be altered to suit requirements.

Figure 3:
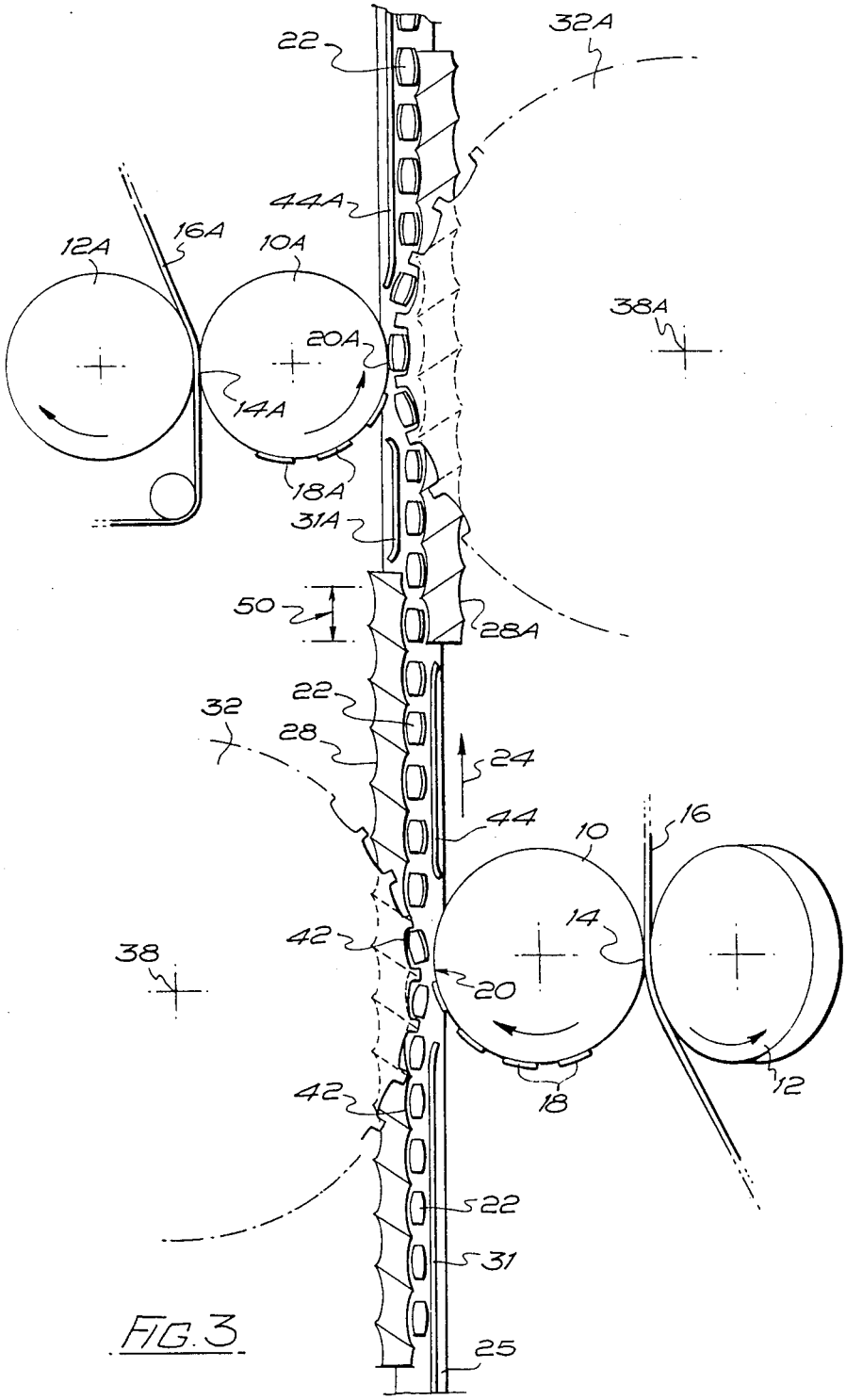
FIG. 3 is a view similar to FIG. 1 showing a second embodiment of the invention.

The arrangement shown in FIG. 3 is a particularly suitable embodiment of the invention and provides for the labelling of opposite sides of the article i.e. the bottles 22 shown in FIG. 1 without the articles substantially moving out of a straight line path of travel. The arrangement in FIG. 3 is in effect a duplication of the arrangement shown in FIG. 1 except that one assembly of scroll star wheel and labelling mechanism is arranged to be of opposite hand to the other assembly. Thus in FIG. 3 the assembly already described in relation to FIG. 1 is shown and also shown is the second assembly of which the parts are identified by similar reference numerals but with the suffix A added thereto.

From the previous description of the operation of the apparatus shown in FIG. 1, the operation of the apparatus in FIG. 3 will be readily understood in that the assembly comprising scroll 28A, vacuum drum 10A, cutting drum 12A and star wheel 32A operate in the opposite direction from the arrangement already described in relation to FIG. 1. The only significant point of note in FIG. 3 is that the scroll 28A overlaps with the scroll 28 in the region 50 and that the scroll 28A obviously turns in the opposite direction from scroll 28. In the said region 50, the articles 22 are held by both scrolls so that as the articles are transferred from one scroll 28 to the other 28A, at no time are they allowed to be free moving and they remain in register with the scroll flights at all times. When the articles 22 have moved out of engagement with the scroll 28 and are engaged by scroll 28A, they are initially held in position by the guide 31A and then are moved by the star wheel 32A into transfer relationship with the vacuum drum 10A whereby the labels 18A can be applied in exact register to the opposite sides of the articles 22.

Although the scroll 28A is shown as extending beyond the nip 20A, it is not necessary that this should be so as the articles after the labelling at nip 28A can then be allowed to be transported freely by the reach 25 of the transporting conveyor.

The significant advantage of the FIG. 3 embodiment is that the scrolls 28 and 28A cooperate so as to keep an engagement with the articles 22 at all times, preventing same from moving out of registry and ensuring the accurate positioning of the labels on the articles, and all of this is achieved without having to invert the articles or to move them off the reach 25 of the transporting conveyor.

I claim:

1. In an article labelling machine comprising:

(a) a feed scroll arranged with its axis horizontal for feeding articles held between the flights in the direction of the feed scroll axis and in fixed pitched relationship;

(b) guide means for holding the articles between the feed scroll flights;

(c) a label applicator drum arranged with its axis vertical;

(d) a star wheel having pockets which are pitched similar to the pitching of the flights of the scroll, said star wheel being arranged with its axis vertical and cooperating with the applicator drum so that labels can be applied to the articles from the drum whilst the articles are held in the star wheel pockets, the improvement comprising that the scroll overlaps the star wheel so as to cooperate intimately therewith; lies slightly within and parallel to the tangent of the star wheel relative to the applicator drum; and extends to opposite sides of the star wheel, and the guide means are at opposite sides of the star wheel whereby the scroll, star wheel and guide means keep a holding control on the articles to maintain the pitching thereof as the articles move towards, into and out of the star wheel pockets.

2. an article feeding device according to claim 1, wherein the star wheel comprises a pair of spaced starred discs and the scroll extends there between.

3. an article feeding device according to claim 2 or 1, wherein there are two of said scrolls, each having a star wheel in overlapping relationship therewith, the scrolls extending in the length direction but on opposite sides of the line of travel of the articles so that operations can be performed thereon to opposite sides of the line of travel, said scrolls being displaced in said length direction so that the trailing end of one of the said scrolls is overlapped by the leading end of the other of said scrolls whereby the articles transfer from said one scroll to the other whilst the scrolls maintain engagement with the articles.

* * * * *